US005653625A

United States Patent [19]

Pierce et al.

[11] Patent Number: 5,653,625

[45] Date of Patent: Aug. 5, 1997

[54] STAR SHOT WAVE TUMBLER SYSTEMS

[76] Inventors: John Pierce; John R. Pierce, both of 78 Hunt Ave. Apt. 4A, Pearl River, N.Y. 10965

[21] Appl. No.: 657,543

[22] Filed: Jun. 4, 1996

[51] Int. Cl.[6] ..... B24B 31/02

[52] U.S. Cl. ..... 451/326; 451/328; 451/330

[58] Field of Search ..... 451/104, 113, 451/106, 326, 328, 330, 32

[56] References Cited

U.S. PATENT DOCUMENTS

| | | | |
|---|---|---|---|
| 90,824 | 6/1869 | Dickinson | 451/330 |
| D. 186,627 | 11/1959 | Romine | 451/326 |
| 591,225 | 10/1897 | Barlett | 451/330 |
| 2,628,460 | 2/1953 | Zinty | 451/328 |
| 2,947,124 | 8/1960 | Mapigan et al. | 451/330 |
| 2,978,850 | 4/1961 | Gleszer | 451/330 |
| 4,753,046 | 6/1988 | Thonney | 451/328 |
| 5,271,184 | 12/1993 | Majors | 451/326 |

*Primary Examiner*—Eileen P. Morgan

[57] ABSTRACT

A new Star Shot Wave Tumbler System for polishing objects such as jewelry or coins with a simple water, soap and scrubbing tumbler shot solution in a short period of time with a quality polish. The inventive device includes a circular tumbler drum to retain the objects being polished, a stability means preventing undue vibration of the circular tumbler drum, a tumbler rotation means rotating the circular tumbler drum, at least one scrubbing tumbler shot for every two jewelry pieces or every two charms or any combination of two thereof, to polish the object and a wave tumbler member to agitate the objects during polishing.

6 Claims, 3 Drawing Sheets

STAR SHOT WAVE TUMBLER SYSTEMS

BACKGROUND OF THE INVENTION

1. Field of the Invention

The present invention relates to Tumbling Apparatus and more particularly pertains to a new Star Shot Wave Tumbler System for polishing objects such as jewelry or charms with a simple water, soap and scrubbing tumbler shot solution in a short period of time with a fine quality preparation before polishing jewelry or charms.

2. Description of the Prior Art

The use of Tumbling Devices is known in the prior art. More specifically, Tumbling Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Tumbling Devices include U.S. Pat. No. 4,021,971; U.S. Pat. No. 5,237,778; U.S. Pat. No. Des. 343,704; U.S. Pat. No. 5,000,209; U.S. Pat. No. 3,894,551 and U.S. Pat. No. 4,556,911.

While these devices fulfill their respective, particular objectives and requirements, the aforementioned patents do not disclose a new Star Shot Wave Tumbler System. The inventive device includes a circular tumbler drum to retain the objects being polished, a stability means preventing undue vibration of the circular tumbler drum, a tumbler rotation means rotating the circular tumbler drum, at least one scrubbing tumbler shot to polish the object and a wave tumbler member to agitate the objects during polishing.

In these respects, the Star Shot Wave Tumbler System according to the present invention substantially departs from the conventional concepts and designs of the prior art, and in so doing provides an apparatus primarily developed for the purpose of polishing objects such as jewelry or charms with a simple water, soap and scrubbing tumbler shot solution in a short period of time with a quality polish.

SUMMARY OF THE INVENTION

In view of the foregoing disadvantages inherent in the known types of Tumbling Devices now present in the prior art, the present invention provides a new Star Shot Wave Tumbler System construction wherein the same can be utilized for polishing objects such as jewelry or charms with a simple water, soap and scrubbing tumbler shot solution in a short period of time with a quality pre-polish before polishing. As such, the general purpose of the present invention, which will be described subsequently in greater detail, is to provide a new Star Shot Wave Tumbler System apparatus and method which has many of the advantages of the Tumbling Devices mentioned heretofore and many novel features that result in a new Star Shot Wave Tumbler System which is not anticipated, rendered obvious, suggested, or even implied by any of the prior art Tumbling Devices, either alone or in any combination thereof.

To attain this, the present invention generally comprises a circular tumbler drum to retain the objects being polished, a stability means preventing undue vibration of the circular tumbler drum, a tumbler rotation means rotating the circular tumbler drum, at least one scrubbing tumbler shot for every two jewelry pieces or every two charms or any combination of two thereof, to polish the object and a wave tumbler member to agitate the objects during polishing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Star Shot Wave Tumbler System apparatus and method which has many of the advantages of the Tumbling Devices mentioned heretofore and many novel features that result in a new Star Shot Wave Tumbler System which is not anticipated, rendered obvious, suggested, or even implied by any of the prior art Tumbling Devices, either alone or in any combination thereof.

It is another object of the present invention to provide a new Star Shot Wave Tumbler System which may be easily and efficiently manufactured and marketed.

It is a further object of the present invention to provide a new Star Shot Wave Tumbler System which is of a durable and reliable construction.

An even further object of the present invention is to provide a new Star Shot Wave Tumbler System which is susceptible of a low cost of manufacture with regard to both materials and labor, and which accordingly is then susceptible of low prices of sale to the consuming public, thereby making such Star Shot Wave Tumbler System economically available to the buying public.

Still yet another object of the present invention is to provide a new Star Shot Wave Tumbler System which provides in the apparatuses and methods of the prior art some of the advantages thereof, while simultaneously overcoming some of the disadvantages normally associated therewith.

Still another object of the present invention is to provide a new Star Shot Wave Tumbler System for polishing objects such as jewelry or charms with a simple water, soap and scrubbing tumbler shot solution in a short period of time with a quality polish.

Yet another object of the present invention is to provide a new Star Shot Wave Tumbler System which includes a circular tumbler drum to retain the objects being polished, a stability means preventing undue vibration of the circular tumbler drum, a tumbler rotation means rotating the circular tumbler drum, at least one scrubbing tumbler shot for every two jewelry pieces or every two charms or any combination of two thereof, to polish the object and a wave tumbler member to agitate the objects during polishing.

Even still another object of the present invention is to provide a new Star Shot Wave Tumbler System wherein the user can polish fine jewelry or coins in a shorter period time with a high quality polish received by the object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
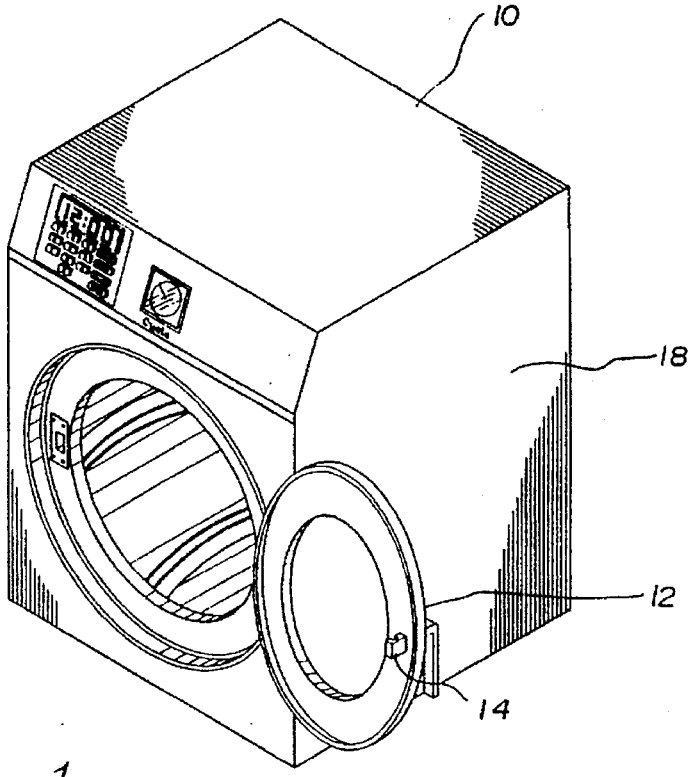
FIG. 1 is a right perspective view of a new Star Shot Wave Tumbler System according to the present invention.
Figure 2:
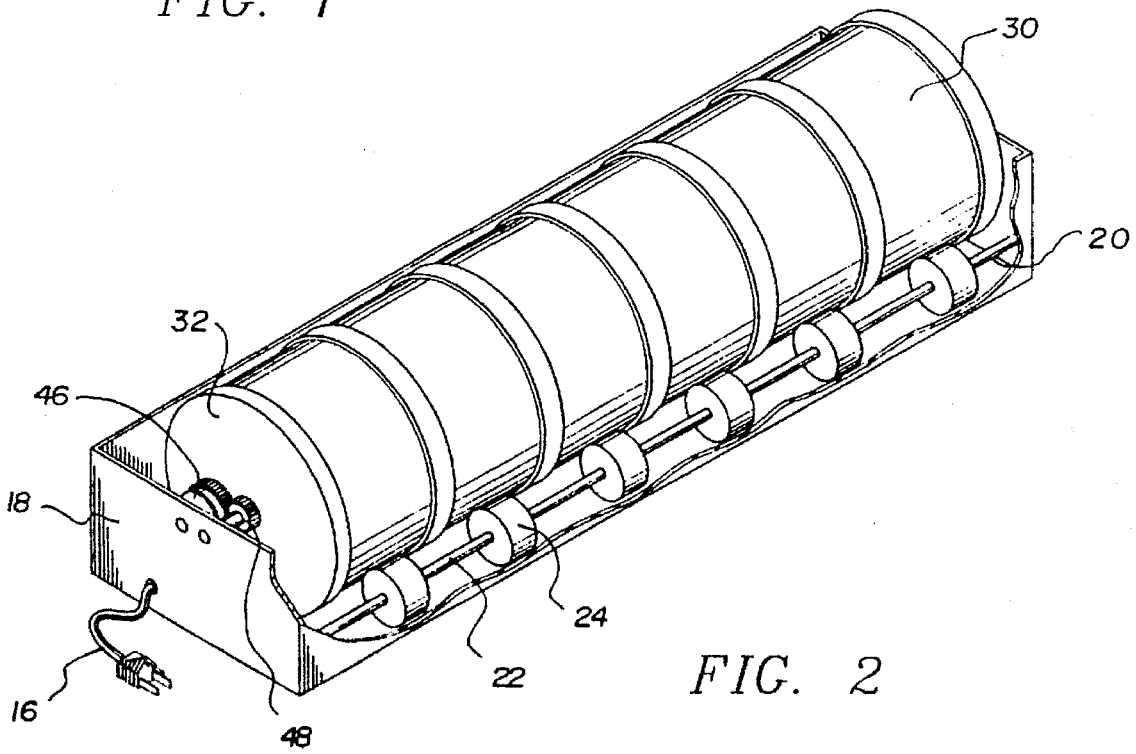
FIG. 2 is a cut-away perspective view thereof.
Figure 3:
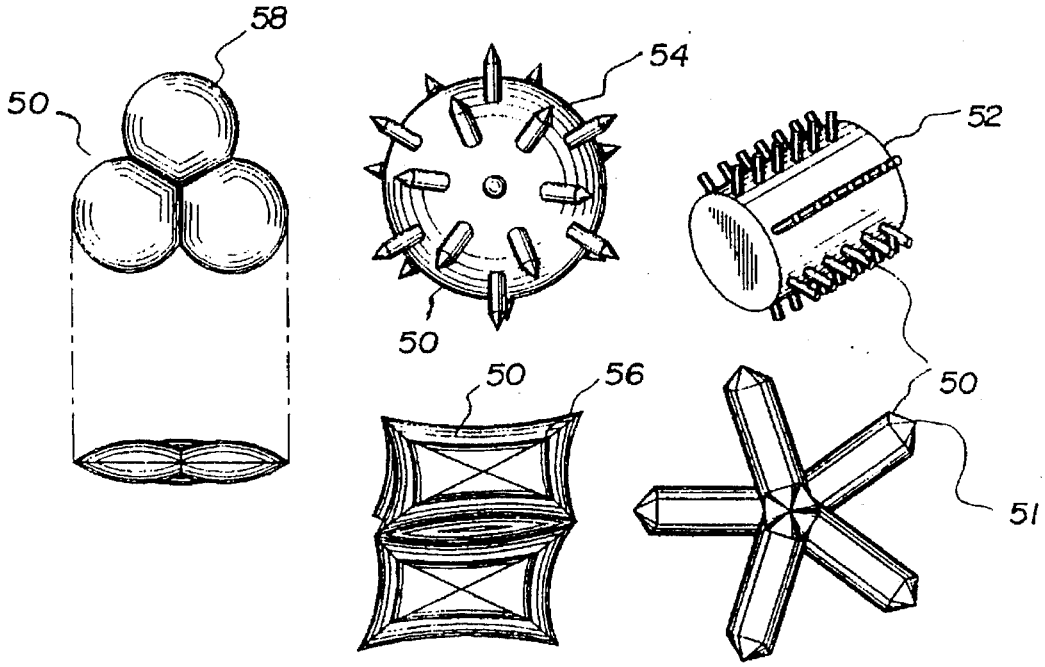
FIG. 3 is perspective views of the different designs of scrubbing tumbler shot.
Figure 4:
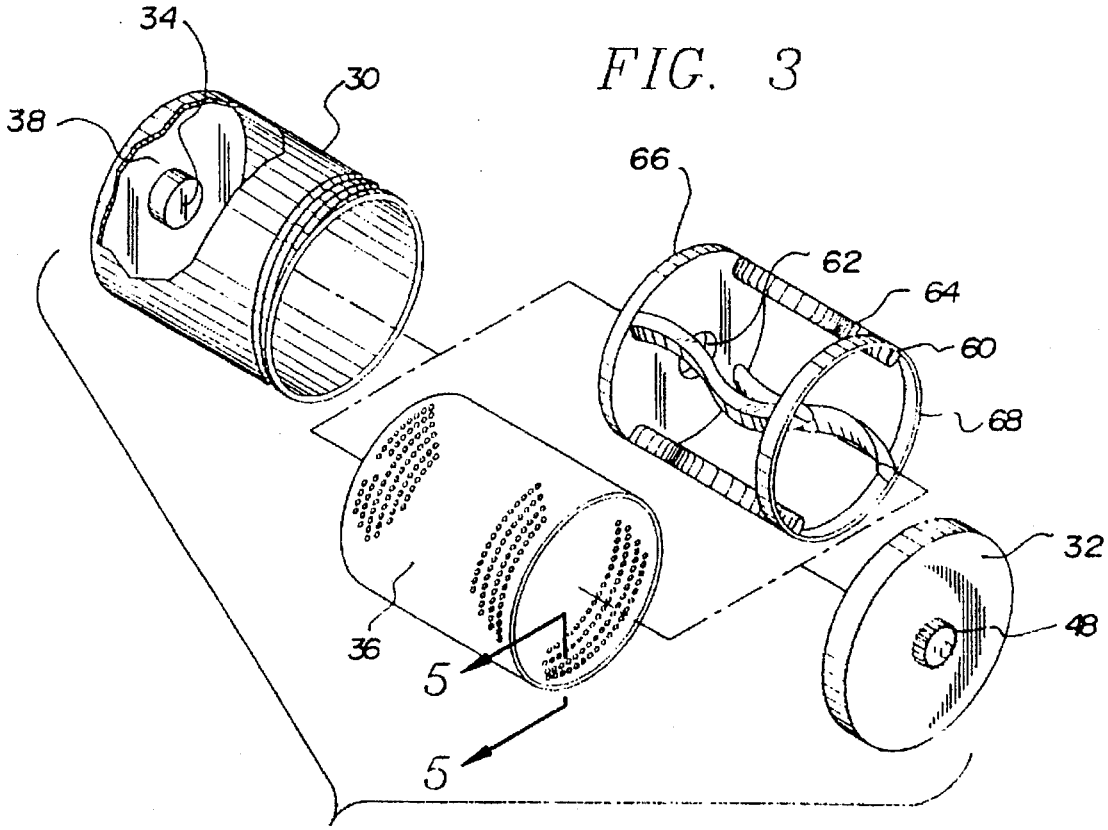
FIG. 4 is an exploded isometric illustration of the present invention.
Figure 5:
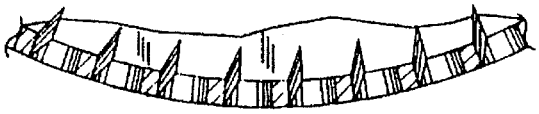
FIG. 5 is a cross sectional view taken along line 5—5 of FIG. 4.
Figure 6:
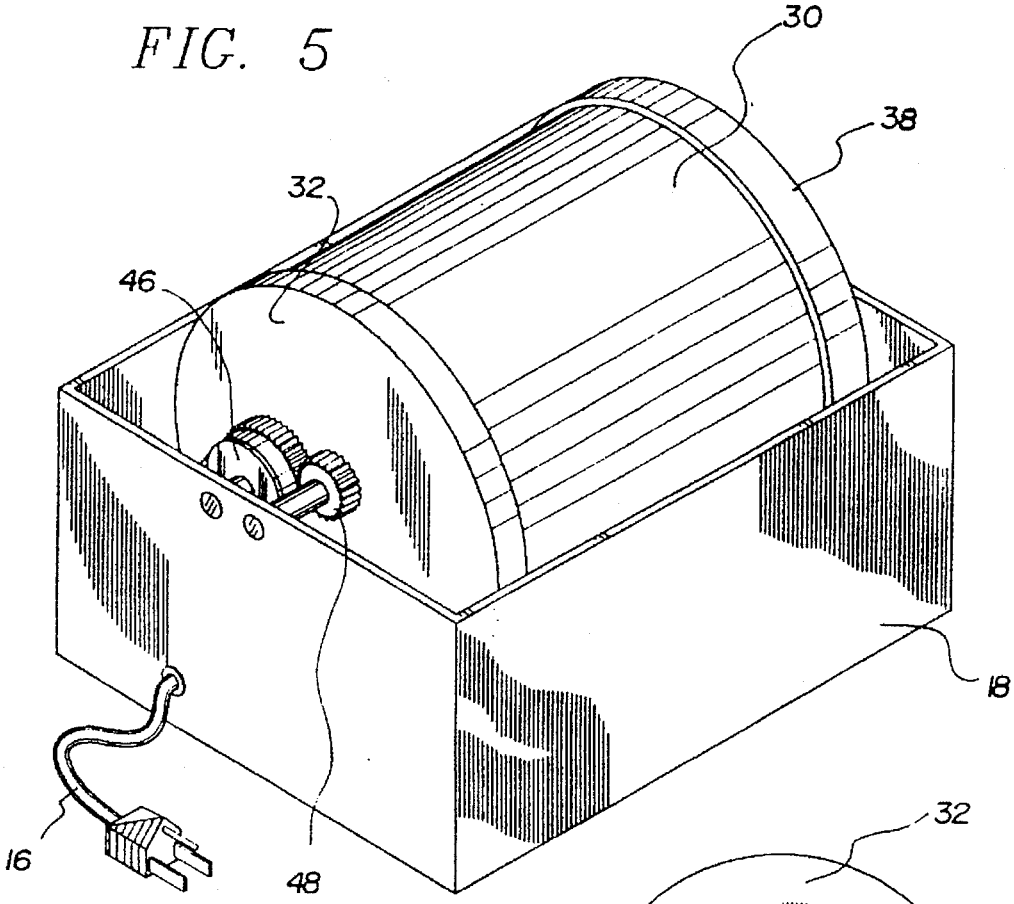
FIG. 6 is a perspective view of another embodiment of the present invention.
Figure 7:
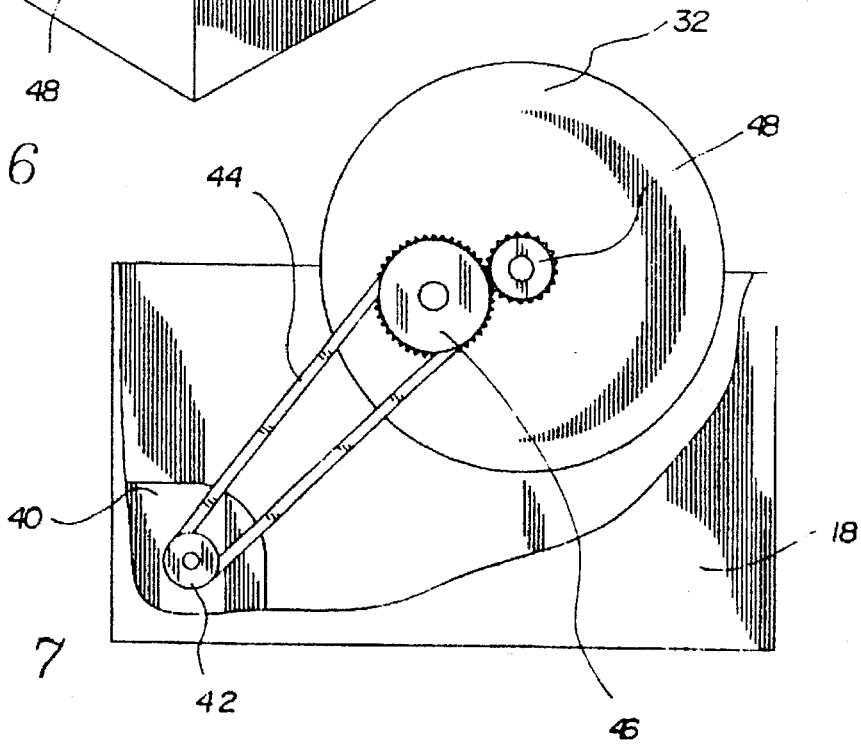
FIG. 7 is a rear cut-away view of the present invention.

With reference now to the drawings, and in particular to FIGS. 1–7 thereof, a new Star Shot Wave Tumbler System embodying the principles and concepts of the present invention and generally designated by the reference numeral 10 will be described.

More specifically, it will be noted that the Star Shot Wave Tumbler System 10 comprises a circular tumbler drum 30, a stability means 20, a tumbler rotation means 40, a wave tumbling member 60, a tumbler encasement body 18 and an unnumbered polishing solution.

As best illustrated in FIGS. 1–2 and 4–7, it can be shown that the circular tumbler drum 30 comprises a first drum enclosing wall 32 and a second drum enclosing wall 38 opposite of the first drum enclosing wall 32 to retain the polishing solution. The tumbler encasement body 18 includes a tumbler door 12 with a tumbler door latch 14 to allow selective insertion and removal of objects through an unnumbered opening within the second drum enclosing wall 38. A circular support member 34 is attached to the center of a drum enclosing wall 32 where the circular support member 34 projects through a wave tumbler aperture 62 inside of a wave tumbling member wall 66 for supporting the wave tumbler (60) during operation. An agitator drum 36 is secured interiorly of the circular tumbler drum 30 to agitate the polishing solution. The agitator drum 36 includes a plurality of unnumbered apertures and surrounds the wave tumbling member 60 to agitate the polishing solution and to retain the object during operation. A stability shaft member 22 extends from one end of the tumbler encasement body 18 to the opposite end of the tumbler encasement body 18. At least one stability roller 24 is attached to the stability shaft member 22 engaging the circular tumbler drum 30 to stabilize the movement of said circular tumbler drum 30. A tumbler rotation means 40 rotates a motor pulley 42 to provide a source of rotation for the circular tumbler drum 30. One end of a drive belt 44 is attached around the motor pulley 42 and the opposite end of the drive belt 44 is attached around a drive gear 46 mounted to the tumbler encasement body 18. A drum drive gear 48 is secured to the center of the outside wall of the first drum enclosing wall 32 engaging the drive gear 46 rotating the circular tumbler drum 30 a higher rotation speed. One end of a wave member 64 is attached to the wave tumbling member wall and the other end of the wave member 64 is attached to a wave tumbling member support ring 68. The wave member 64 is formed to the shape of a wave pattern to maximize agitation effectiveness. The wave tumbling member 60 is positioned interiorly of the agitator drum 36 to agitate the objects during polishing. The polishing solution comprises water, soap and at least one star scrubbing tumbler shot 51, a barbed drum scrubbing tumbler shot 52, a spiked cylinder scrubbing tumbler shot 54, a rectangle scrubbing tumbler shot 56, or a oval scrubbing tumbler shot 58 to obtain optimal polishing of objects in the present invention 10. The shots move briskly against the objects during polishing to give a quality polish.

The scrubbing tumbler shot solution comprises water, soap and at least one scrubbing tumbler shot 50 mixed inside of the circular tumbler drum 30 with the objects being polished. The tumbler rotation means 40 rotates the circular tumbler drum 30 polishing the objects. The stability means 20 prevents undue vibration of the circular tumbler drum 30 during polishing. The wave tumbling member 60 and polishing solution agitate against the objects being polished providing a quality polish.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Star Shot Wave Tumbler System comprising:

a tumbler encasement body to protect the user;

a circular tumbler drum inside of the tumbler encasement body;

a stability means to stabilize the circular tumbler drum;

a tumbler rotation means rotating the circular tumbler drum;

a polishing solution inside of the circular tumbler drum;

a wave tumbling member mounted interiorly of the circular tumbler drum to agitate an object being polished;

the wave tumbling member includes a wave tumbling member wall having a concentric wave tumbler aperture;

the circular tumbler drum comprises:

a first drum enclosing wall attached at one end of the circular tumbler drum;

a second drum enclosing wall attached to the circular tumbler drum opposite of the first drum enclosing wall retaining the polishing solution;

a circular support member attached to an interior wall of the second drum enclosing wall for projecting through the wave tumbler aperture for supporting the wave tumbling member;

an agitator drum surrounds the wave tumbling member to agitate the polishing solution and to retain the object during operation;

the tumbler rotation means comprises:

a motor means;

a motor pulley connected to a drive shaft from the motor means;

a drive belt engaging the motor pulley;

a drive gear mounted to the tumbler encasement body engaging the end of the drive belt opposite of the motor pulley;

a drum drive gear mounted to the center of the first drum enclosing wall engaging the drive gear to increase the rotation speed of the circular tumbler drum;

the tumbler encasement body includes a tumbler door at one end with a tumbler door latch to allow selective insertion and removal of objects through an opening within the second drum enclosing wall; and the polishing solution comprises:

a liquid;

a cleaning solution mixed with the liquid; and at least one scrubbing tumbler shot.

2. The Star Shot Wave Tumbler System of claim 1, wherein the scrubbing tumbler shot is shaped as a star.

3. The Star Shot Wave Tumbler System of claim 2, wherein the scrubbing tumbler shot is shaped as a barbed drum.

4. The Star Shot Wave Tumbler System of claim 3, wherein the scrubbing tumbler shot is shaped as a spiked cylinder.

5. The Star Shot Wave Tumbler System of claim 4, wherein the scrubbing tumbler shot is shaped as a rectangle.

6. The Star Shot Wave Tumbler System of claim 5, wherein the scrubbing tumbler shot is shaped as a three-legged oval.

* * * * *